US008432327B2

(12) United States Patent
Chow et al.

(10) Patent No.: US 8,432,327 B2
(45) Date of Patent: Apr. 30, 2013

(54) DUAL-BAND DIPOLE ANTENNA

(75) Inventors: John Chow, Saratoga, CA (US); Yun-Cheng Hou, Tu-Cheng (TW); Chang-Ching Lin, Tu-Cheng (TW); Sheng-Che Chang, Tu-Cheng (TW); Chun-Chieh Tseng, Tu-Cheng (TW); Taiichi Yamaguchi, Yokohama (JP)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 400 days.

(21) Appl. No.: 12/787,380

(22) Filed: May 25, 2010

(65) Prior Publication Data

US 2010/0295746 A1 Nov. 25, 2010

(51) Int. Cl.
*H01Q 9/16* (2006.01)

(52) U.S. Cl.
USPC ..... 343/793; 343/795; 343/820

(58) Field of Classification Search ..... 343/793, 343/795, 820–822
See application file for complete search history.

(56) References Cited

U.S. PATENT DOCUMENTS 5,406,295 A 4/1995 Baranski et al.
6,906,678 B2 6/2005 Chen
2002/0190912 A1* 12/2002 Lebaric et al. ..... 343/795
2004/0108955 A1 6/2004 SjoBlom
2005/0237252 A1* 10/2005 Thudor et al. ..... 343/770
2007/0024503 A1* 2/2007 Tsai et al. ..... 343/700 MS

FOREIGN PATENT DOCUMENTS

TW M266567 6/2005

OTHER PUBLICATIONS

Multi-Band Operation of a Compact H-Shaped Microstrip Antenna, Microwave and Optical Technology Letters, Dec. 5, 2002, vol. 35, No. 5.

* cited by examiner

*Primary Examiner* — Anh Tran
(74) *Attorney, Agent, or Firm* — Wei Te Chung; Ming-Chieh Chang

(57) ABSTRACT

A dual-band dipole antenna (100) includes a ground radiating portion (2), a signal radiating portion (3) and a feed wire (1). The feed wire (1) has a ground portion (12) connected to the ground radiating portion (2), and a core conduct (11) connected to the signal radiating portion (3). The signal radiating portion (3) has a first branch (31), a second branch (32) having a same length and a same width as the first branch (31), and a middle portion (33) connecting the first branch (31) and the second branch (32) at connecting points. Each of the first branch (31) and the second branch (32) has a first radiating length (D1) extending from the connecting point and a second radiating length (D2) extending from the connecting point.

8 Claims, 7 Drawing Sheets

DUAL-BAND DIPOLE ANTENNA

BACKGROUND OF THE INVENTION

1. Field of the Invention

The present invention relates to a dual-band Dipole antenna.

2. Description of Related Art

Taiwan Utility Model patent TW M266567 discloses a dual band non-directional antenna. The antenna is combined from a monopole antenna and a dipole antenna. The antenna can work at two frequencies but with narrow band.

So there is a need to provide an antenna of this kind with broader band.

SUMMARY OF THE INVENTION

An object of the present invention is to provide a dual-band dipole antenna comprising a ground radiating portion, a signal radiating portion and a feed wire. The feed wire has a ground portion connected to the ground radiating portion, and a core conduct connected to the signal radiating portion. The signal radiating portion has a first branch, a second branch having a same length and a same width as the first branch, and a middle portion connecting the first branch and the second branch at connecting points. Each of the first branch and the second branch has a first radiating length extending from the connecting point and a second radiating length extending from the connecting point. The core conduct is connected to the middle portion.

Another object of the present invention is to provide a dual-band dipole antenna comprising a ground radiating portion, a signal radiating portion and a feed wire. The signal radiating portion has a first linear branch, a second linear branch and a middle portion connecting the first branch and the second branch at connecting points, each of the first branch and the second branch having a first radiating length downwardly extending from the connecting point and a second radiating length upwardly extending from the connecting point. The feed wire has a ground portion connected to the ground radiating portion, and a core conduct connected to the middle portion.

Other objects, advantages and novel features of the invention will become more apparent from the following detailed description of a preferred embodiment when taken in conjunction with the accompanying drawings.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
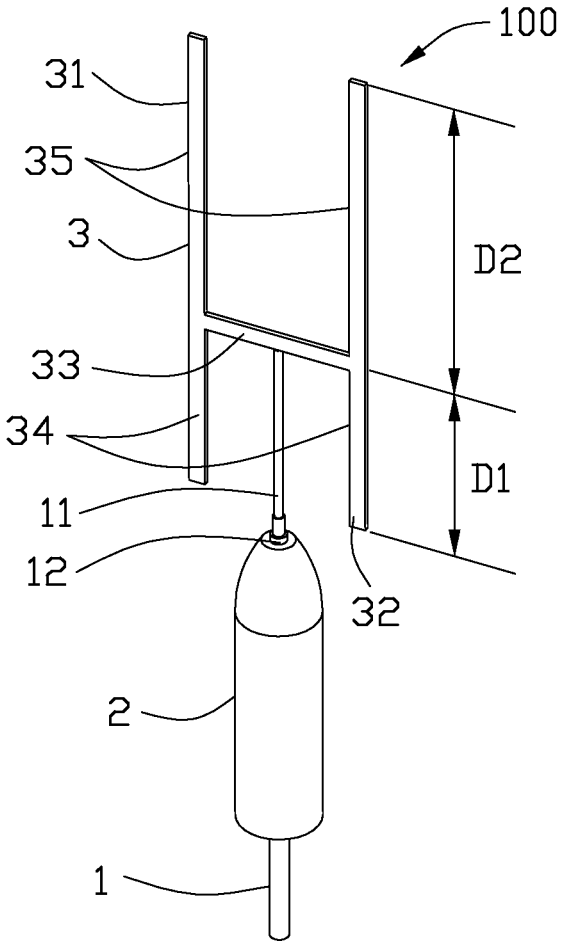
FIG. 1 is a perspective view of a dual-band dipole antenna according to the present invention.

Reference will now be made to the drawing figures to describe the present invention in detail.

Referring to FIG. 1, a dual-band dipole antenna 100 comprises a ground radiating portion 2, a signal radiating portion 3 and a feed wire 1. The feed wire 1 has a ground portion 12 connected to the ground radiating portion 2, and a core conductor 11 connected to the signal radiating portion 3. The signal radiating portion 3 is substantially a planar frame punched from a metal sheet. The ground radiating portion 2 has a conical portion and a cylindrical portion continuously extending from the conical portion.

The signal radiating portion 3 has a first branch 31, a second branch 32 having a same length and a same width as the first branch 31, and a middle portion 33 connecting the first branch 31 and the second branch 32 at connecting points. Each of the first branch 31 and the second branch 32 has a first radiating length D1 extending downwardly from the connecting point and a second radiating length D2 extending upwardly from the connecting point. The first radiating length D1 is shorter than the second radiating length D2. The middle portion 33 extends horizontally and perpendicular to the first branch 31 and the second branch 32. The core conductor 11 is connected at a mid-point of the middle portion 33.

Figure 2:
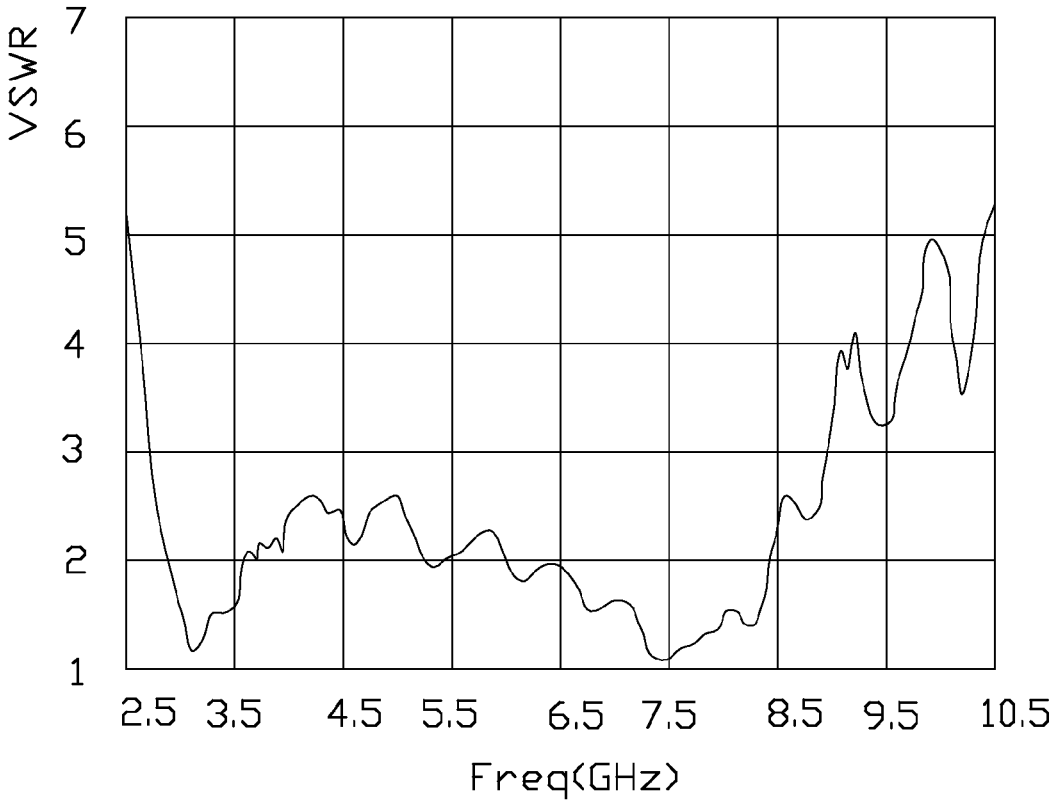
FIG. 2 is the VSWR chart of the antenna shown in FIG. 1.
Figure 3:
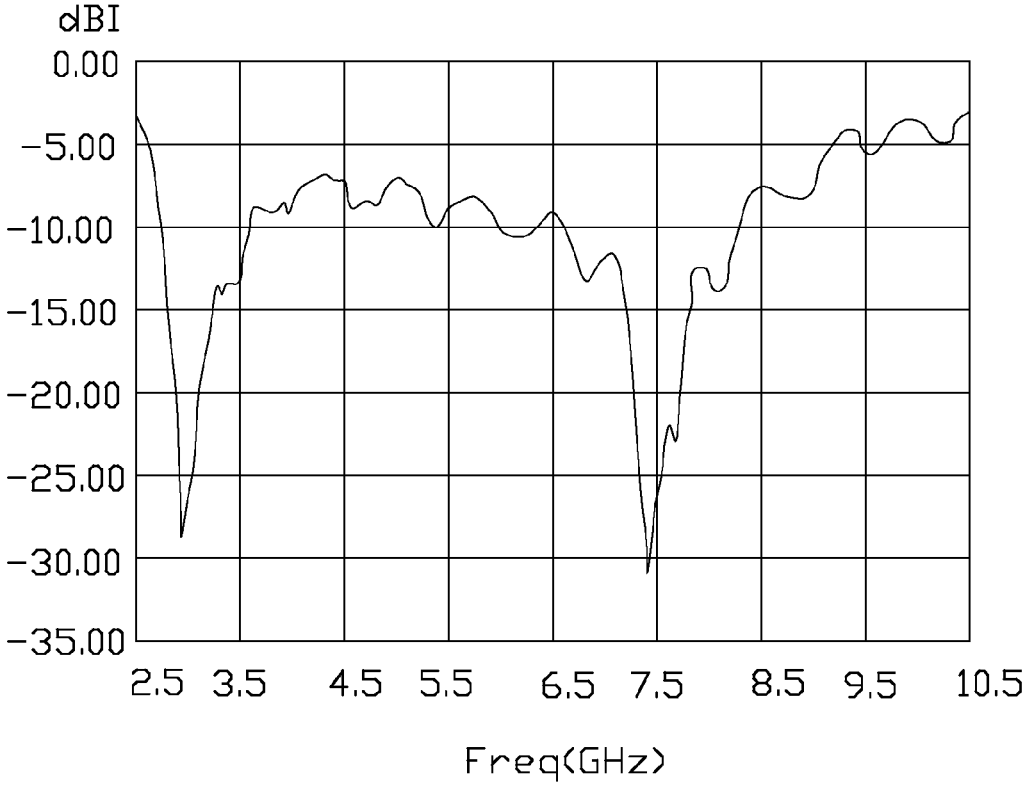
FIG. 3 is the return loss chart of the antenna shown in FIG. 1.
Figure 4:
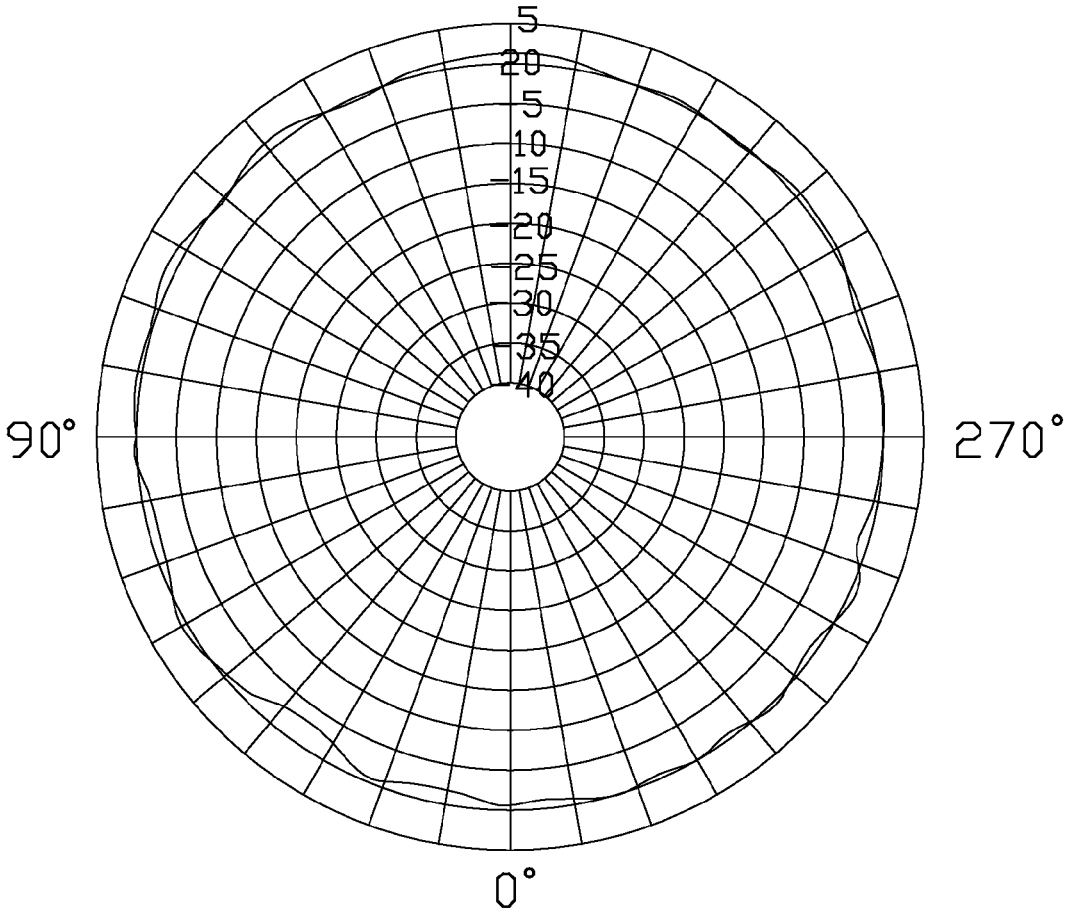
FIGS. 4-7 are the antenna field pattern diagrams of the antenna shown in FIG. 1, respectively at 3.168 GHz, 4.725 GHz, 7.392 GHz, and 9.24 GHz.
Figure 5:
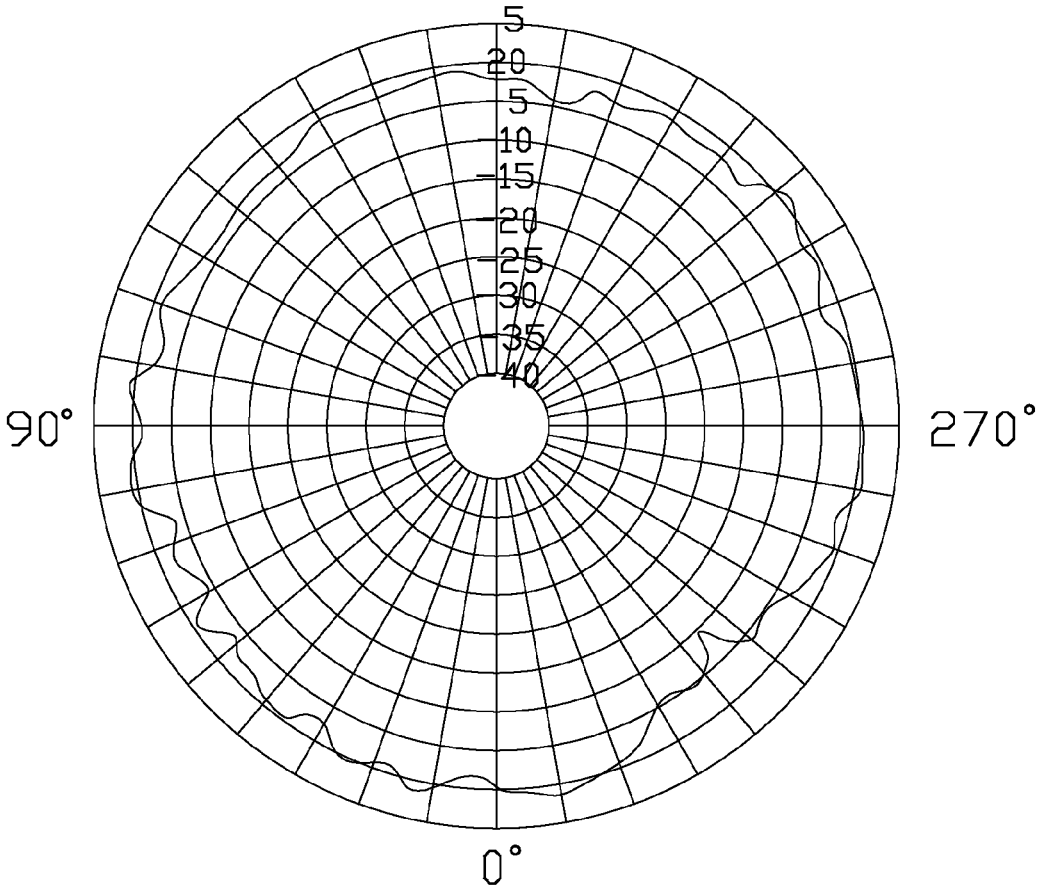
Figure 6:
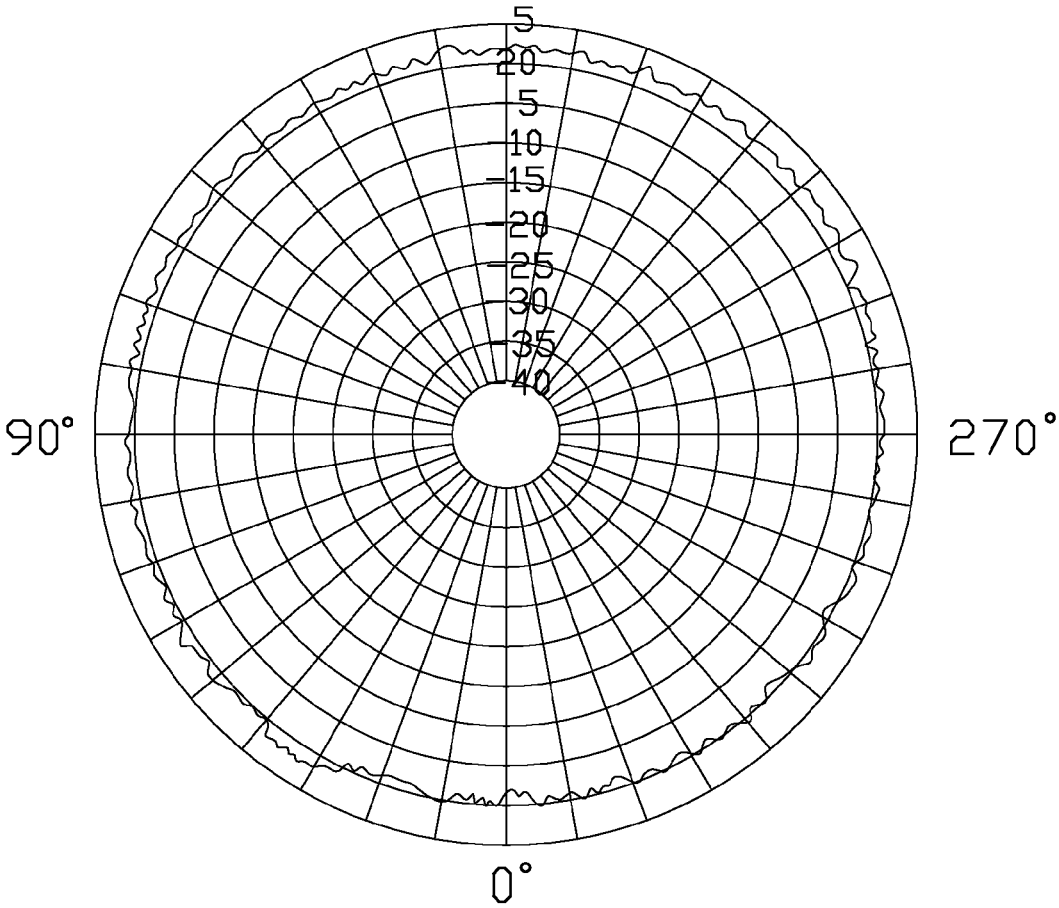
Figure 7:
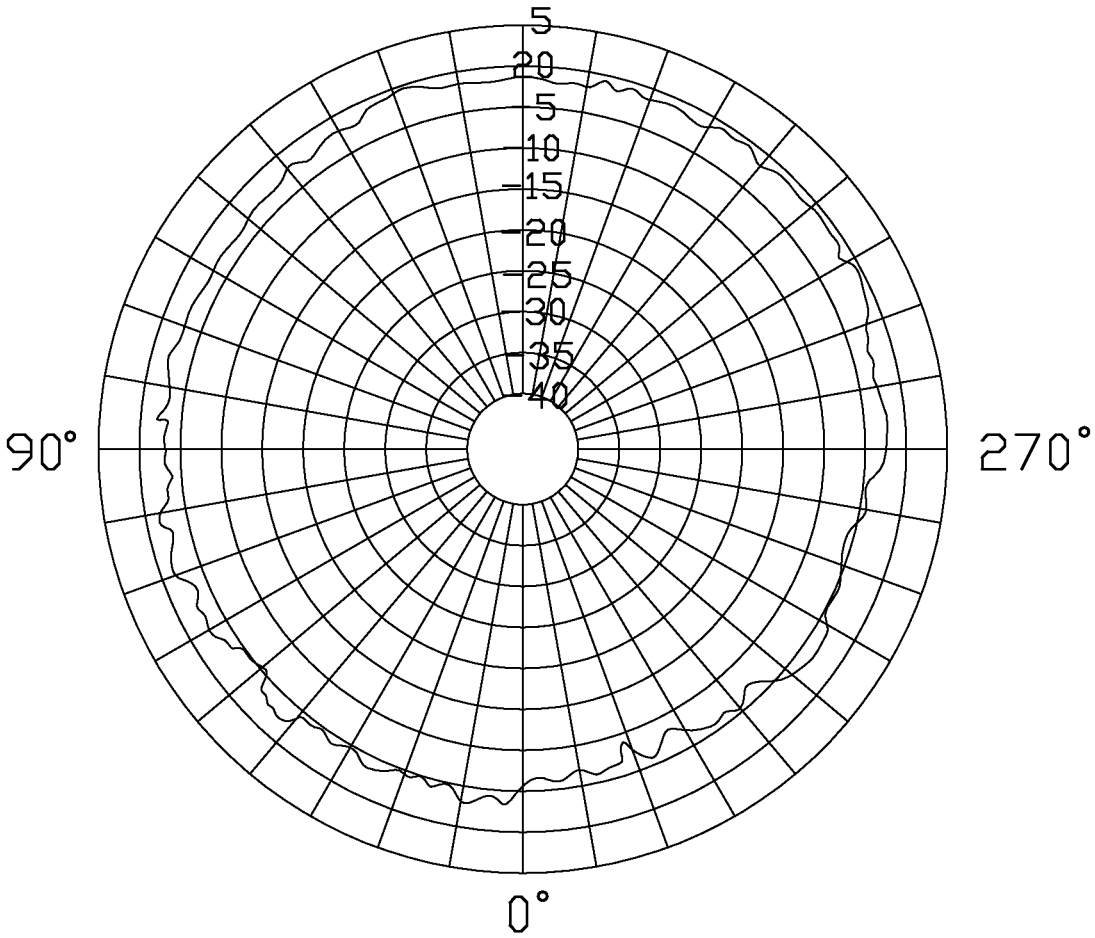

Referring to FIGS. 2 and 3, between 3.168 GHz and 9.24 GHz, the voltage standing wave ratio (VSWR) of the antenna 100 is smaller than 4.0, and the returning loss of the antenna is smaller than 5 dB.

Referring to FIGS. 4 to 7, antenna field pattern diagrams of the antenna 100, respectively at 3.168 GHz, 4.725 GHz, 7.392 GHz, and 9.24 GHz, show that the antenna 100 has good radiation between 3.168 GHz and 9.240 GHz.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual-band dipole antenna comprising:

a ground radiating portion;

a signal radiating portion having a first branch, a second branch having a same length and a same width as the first branch, and a middle portion connecting the first branch and the second branch at connecting points, each of the first branch and the second branch having a first radiating length extending from the connecting point and a second radiating length oppositely extending from the connecting point; and a feed wire having a ground portion connected to the ground radiating portion, and a core conduct connected to the middle portion;

wherein the signal radiating portion is substantially planar;

wherein the first branch extends parallel to the second branch; and wherein the first radiating length is shorter than the second radiating length.

2. A dual-band dipole antenna as claimed in claim 1, wherein the middle portion extends horizontally and perpendicular to the first and the second branches.

3. A dual-band dipole antenna as claimed in claim 1, wherein the signal radiating portion has a planar frame punched form a metal sheet and the ground radiating portion has a conical portion and a cylindrical portion continuously extending from the con-shaped portion.

4. A dual-band dipole antenna comprising:

a ground radiating portion defining opposite first and second ends thereof;

a feed wire including inner and outer conductors and approaching from an exterior and extend through said ground radiating portion from the second end toward the first end under condition that only the inner conductor essentially extends outwardly from the first end of the radiating portion;

a signal radiating portion defining a H-shaped configuration including a horizontal section linked between a pair of vertical sections; wherein the inner conductor is linked to the horizontal section.

5. The dual-band dipole antenna as claimed in claim 4, wherein said inner conductor is connected to essentially a center point of said horizontal section.

6. The dual-band dipole antenna as claimed in claim 4, wherein each of said vertical sections is divided into first and second parts by the horizontal section with different lengths thereof.

7. The dual-band dipole antenna as claimed in claim 6, wherein the second part, which is closer to the ground portion than the first part, is shorter than the first part.

8. The dual-band dipole antenna as claimed in claim 7, wherein the inner conductor exposed between the signal radiating portion and the ground radiating portion, is not shorter than the second part so as not to have a tip of the ground radiating portion invade an area defined by a boundary of said signal radiating portion.

* * * * *